US006173792B1

(12) United States Patent
Hald

(10) Patent No.: US 6,173,792 B1
(45) Date of Patent: Jan. 16, 2001

(54) POWER-DRIVEN SCREWDRIVER WITH TORQUE-DEPENDENT RELEASE CLUTCH

(75) Inventor: Ewald Hald, Filderstadt (DE)

(73) Assignee: C. & E. Fein GmbH & Co., Stuttgart (DE)

( * ) Notice: Under 35 U.S.C. 154(b), the term of this patent shall be extended for 0 days.

(21) Appl. No.: 09/388,719

(22) Filed: Sep. 2, 1999

(30) Foreign Application Priority Data

Sep. 30, 1998 (DE) ..... 198 45 024

(51) Int. Cl.[7] ..... B25B 21/00
(52) U.S. Cl. ..... 173/178; 173/48; 192/150
(58) Field of Search ..... 173/176, 178, 173/48, 216; 192/150, 54.5; 81/467, 469, 470, 473

(56) References Cited

U.S. PATENT DOCUMENTS

| | | | | |
|---|---|---|---|---|
| 3,834,252 | | 9/1974 | Abell et al. . | |
| 4,284,017 | | 8/1981 | Starr . | |
| 4,966,057 | * | 10/1990 | Koppatsch | 81/469 |
| 5,174,424 | | 12/1992 | Erickson . | |
| 5,195,624 | | 3/1993 | Erickson . | |
| 5,209,308 | * | 5/1993 | Sasaki | 173/178 |
| 5,372,206 | * | 12/1994 | Sasaki et al. | 81/473 |
| 5,531,278 | * | 7/1996 | Lin | 173/48 |
| 5,538,089 | * | 7/1996 | Sanford | 192/54.5 |
| 5,947,210 | * | 9/1999 | Sasaki et al. | 173/178 |

FOREIGN PATENT DOCUMENTS

| | | |
|---|---|---|
| 24 27 713 A1 | 1/1975 | (DE) . |
| 2920065 | 11/1980 | (DE) . |
| 3431630 A1 | 3/1986 | (DE) . |
| 39 18 791 A1 | 7/1990 | (DE) . |
| 4310624 A1 | 10/1993 | (DE) . |
| 0 437 060 A2 | 12/1990 | (EP) . |

* cited by examiner

*Primary Examiner*—Scott A. Smith
(74) *Attorney, Agent, or Firm*—Cummings & Lockwood

(57) ABSTRACT

A power-driven screwdriver with a torque-dependent release clutch having two clutch halves is disclosed. The screwdriver comprises additional entrainment elements provided on the clutch halves for bridging the release clutch. To this end, a motor-driven drive gear is mounted to rotate freely on a tool drive shaft and is secured against axial displacement on the housing side while a cam ring can be adjusted axially, together with the tool drive shaft, via an adjusting device. The clutch elements are formed on the respectively facing sides of the drive gear and the cam ring, and the entrainment element are likewise formed, as separate elements, on the respectively facing sides of the drive gear and the cam ring. As a result of the adjusting device axial displacement of the tool drive shaft results either in a rigid through drive, where the release clutch is nonfunctional, or in the torque-dependent release of the release clutch, where the entrainment elements are nonfunctional.

12 Claims, 2 Drawing Sheets

POWER-DRIVEN SCREWDRIVER WITH TORQUE-DEPENDENT RELEASE CLUTCH

BACKGROUND OF THE INVENTION

The present invention relates to a power-driven screwdriver comprising:

a housing;

an axially displaceable tool drive shaft, mounted rotatably in the housing, that is mounted at a first end in the housing and at its second end has a receptacle for a tool;

a motor-driven drive gear, mounted rotatably on the tool drive shaft, that on the housing side is secured against axial displacement;

a cam ring that is axially immobilized on the tool drive shaft and is secured against axial displacements outward;

a spring element in order to preload the tool drive shaft outward toward the receptacle;

first clutch elements on the drive gear;

second clutch elements on the cam ring that coact with the first clutch elements in order to constitute a torque-dependent release clutch; and an adjusting device for axial adjustment of the tool drive shaft.

Screwdrivers of this kind, having an adjustable, torque-dependent shutoff clutch that generally has mutually coacting cam elements with oblique flanks, have been common for years.

An example of one such screwdriver is represented by the screwdriver marketed under the designation "ASse639" (cf. general catalog of the Applicant, "Fein Hochleistungs-Elektrowerkzeuge" 1995/96, pages 78, 79, 224).

In many situations it is desirable in this context to make the torque-dependent shutoff clutch nonfunctional, for example if the screwdriver is to be used for drilling. For this purpose, it is known to clamp the two clutch elements, which have cams with oblique entraining flanks, to one another so that torque-dependent release is prevented. This situation is referred to as "rigid through drive."

The disadvantage of a configuration of this kind is that because of the oblique cams, very large axial forces occur and must be absorbed by the bearings.

Although a variety of solutions are known in the existing art for rigidly coupling a drive shaft and an output shaft to one another (cf. U.S. Pat. Nos. 5,016,501, 3,243,023, and EP-A-0 792 723), coupling mechanisms of this kind are of complex construction and are poorly suited for use in a simple screwdriver with a torque-dependent release clutch (single-claw clutch).

SUMMARY OF THE INVENTION

It is therefore a first object of the invention to disclose an improved screwdriver comprising a clutch that releases in torque-dependent fashion and which can be selectively made nonfunctional so that rigid through drive is achieved.

It is a second object of the invention to disclose an improved power-driven screwdriver having a torque-dependent release clutch and being of simple design and of reliable construction.

According to the present invention these and other objects are achieved, in the case of a screwdriver of the kind cited initially, in that first entrainment elements, which coact with second entrainment elements on the cam gear for positive power transfer, are provided on the drive gear; and that the adjusting device allows an axial adjustment of the tool drive shaft in such a way that in a first position the first and second entrainment elements are in positive engagement with one another, and in a second position the entrainment elements are out of engagement, while the clutch elements are in engagement with one another.

These objects of the invention are completely achieved in this fashion.

The use of additional entrainment elements on the drive gear and on the cam ring brings about, in simple fashion, a positive power transfer from the drive gear to the cam ring and thus to the tool drive shaft; for switchover, the adjusting device that is present in any case is used for axial adjustment of the tool drive shaft, so that in a first position the entrainment elements on the drive gear and on the cam ring are in positive engagement with one another, and in a second, axially displaced position of the tool drive shaft, only the clutch elements are in engagement with one another, so that the release clutch can release in torque-dependent fashion.

The result is to achieve, with simple means, a particularly reliable capability for switching between torque-dependent shutoff and rigid through drive, the disadvantages of the existing art, such as high axial forces, being avoided.

According to a further embodiment of the invention, the clutch elements and the entrainment elements are arranged on the respectively facing sides of the drive gear.

This results in a particular simple configuration.

According to an advantageous development of the invention, the clutch elements are out of engagement in the first position.

This feature ensures that when the screwdriver is set to the first position (rigid through drive), the clutch elements are out of engagement and thus also cannot exert any further axial forces. This simplifies the construction and relieves loads on the bearings.

In an additional development of the invention, the clutch elements are configured as cam elements with oblique flanks.

This results in a particularly simple construction of the mutually coacting clutch elements. Alternatively, however, it would also be conceivable to provide, for example, curved entrainment flanks on one clutch half that coact with suitable entrainment elements, e.g. a straight pin, on the other clutch half.

In an additional development of the invention, the entrainment elements are configured as claw elements with straight flanks axially parallel to the rotation axis.

This ensures a particularly simple construction of the entrainment elements.

According to a further embodiment of the invention, at least two, preferably three, first clutch elements are arranged on the drive gear at uniform angular distances from one another; and at least two, preferably three, first entrainment elements are arranged on the drive gear at uniform angular distances from one another, and associated therewith are respective correspondingly arranged and shaped second clutch elements and entrainment elements on the cam ring, the first and second entrainment elements each extending over an angle at center that is greater than the angle at center over which the clutch elements extend.

This guarantees, with simple means, that in the first position (rigid through drive), the clutch elements are nonfunctional and thus cannot exert any axial forces. At the same time, the result is that the first and second entrainment elements are nonfunctional in the second position (torque-dependent shutoff).

With this embodiment, the first and second clutch elements are preferably constructed so that when viewed in the axial direction, they have a height greater than the height of the first and second entrainment elements.

In an additional development of this embodiment, the clutch elements are arranged on a circle that is offset concentrically outward with respect to the entrainment elements, each clutch element preferably being associated with an entrainment element in a radially outwardly offset position.

These features make possible a particularly stable construction of the clutch elements and entrainment elements, and allow the clutch elements to be designed generously, since the latter can transfer greater forces because of the radially outwardly offset position. Another result achieved is that minimal wear phenomena occur, even in continuous operation.

According to a further feature of the invention, the adjusting device comprises an adjusting sleeve that is guided on the housing adjustably in the axial direction by way of threads; a snap ring that is rotatable with respect to the housing and can be immobilized in snap-lock fashion in various angular positions is immobilized on the adjusting sleeve in axially displaceable fashion and nonrotatably with respect to the latter.

It is thereby possible to achieve easy adjustment of the release torque of the release clutch that is to release in torque-dependent fashion, and to combine that with a corresponding adjustment in order to ensure rigid through drive.

In an additional development of the invention, an axial bearing that is supported on the housing via a resilient element, preferably via an O-ring, is provided to support the drive gear.

The advantage of this feature is that a tendency toward jamming that possibly exists during the transition between the first and second positions of the tool drive shaft, especially when starting up, is avoided by way of the resilient mounting system of the drive gear, and at the same time a certain damping is achieved in the event that an adjustment of the adjusting ring is performed during operation. Wear phenomena resulting from adjustment of the adjusting ring during operation are thereby greatly reduced.

It is understood that the features mentioned above and those yet to be explained below can be used not only in the respective combinations indicated, but also in other combinations or in isolation, without leaving the context of the present invention.

SHORT DESCRIPTION OF THE DRAWINGS

Further features and advantages of the invention are evident from the description below of a preferred exemplary embodiment with reference to the drawings, in which.

DETAILED DESCRIPTION OF THE PREFERRED EMBODIMENT

Figure 1:
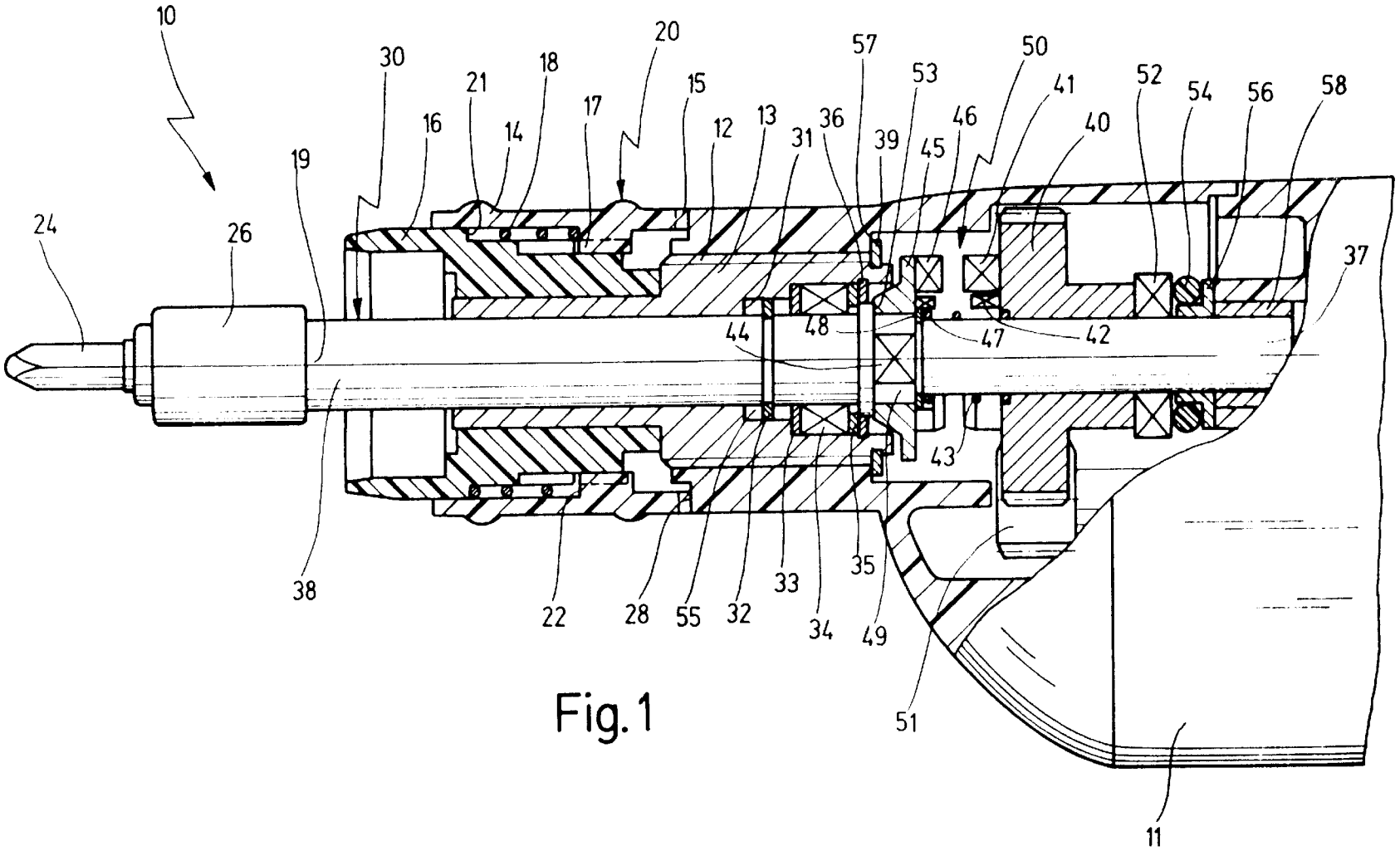
FIG. 1 shows a partial longitudinal section through a screwdriver according to the present invention.

In FIG. 1, a screwdriver according to the present invention is labeled in its entirety with the number 10.

Screwdriver 10 comprises a housing 11 in which is received an electric motor (not shown) that drives, via a pinion 51, a drive gear 40 meshing therewith. Further parts of the drive train thus constituted are not shown. Drive gear 40 is mounted in freely rotatable fashion on a tool drive shaft 30 that is mounted at its first end 37 in housing 11 by way of a radial bearing 50, and at its second end 38 has a receptacle 26 for a tool 24, e.g. a screwdriver bit.

A cam ring 45 is immobilized on tool drive shaft 30 and joined positively thereto. A release clutch labeled in its entirety with the number 50 is constituted between cam ring 45 and drive gear 40. This release clutch 50 has first clutch elements 41 on a side of drive gear 40 facing toward cam ring 45, associated with which are second clutch elements 46 on a side of cam ring 45 facing toward drive gear 40.

Also arranged between cam ring 45 and drive gear 40 is a spring element 43, in the form of a helical compression spring, with which cam ring 45 and thus also tool drive shaft 30, which is arranged in axially displaceable fashion together with cam ring 45, can be acted upon in an outward direction, i.e. toward receptacle 26.

The torque of drive gear 40 can thus be transferred, when release clutch 50 is closed, from drive gear 40 via cam ring 45 to tool drive shaft 30 in order to drive tool 24.

Clutch elements 41 and 46 on drive gear 40 and on cam ring 45, respectively, are configured as cam elements with flat, oblique flanks, whose shape will be explained below with reference to FIGS. 2 and 3.

Cam ring 45 rests against a tool-side shoulder 53 of tool drive shaft 30, and on the side of drive gear 40 is retained by a retaining ring 48. In order to ensure positive power transfer from cam ring 45 to tool drive shaft 30, cam ring 45 has a central recess 49 that is equipped, on two sides opposite one another, with flattened areas 49 that, together with corresponding flattened areas on tool drive shaft 30, constitute a positive engagement.

By way of an adjusting device labeled in its entirety with the number 20, tool drive shaft 30 together with cam ring 45 can be axially adjusted toward drive gear 40 so as thereby to modify the overlap between the oblique flanks of clutch elements 41, 46.

In combination with the preload force via spring element 43, the result is thus, depending on the overlap established between clutch elements 41, 46, a torque-dependent release torque for release clutch 50 that is additionally influenced by the compressive force as screwdriver 10 with tool 24 is pushed down.

Adjusting device 20 for adjusting tool drive shaft 30 toward drive gear 40 comprises an adjusting sleeve 13, surrounding tool drive shaft 30, that is joined in axially adjustable fashion to housing 11 via threads 12. Pressed onto an outer region of adjusting sleeve 13 is a sleeve 16 that is thereby joined nonrotatably and in axially nondisplaceable fashion to adjusting sleeve 13.

A snap ring 14 that can be grasped from outside, and that is arranged in axially displaceable fashion on sleeve 16, is provided order to allow rotation of adjusting sleeve 13 and thus axial adjustment of tool drive shaft 30. Snap ring 14 is guided between sleeve 16 and snap ring 14 on sleeve 16, via an axial guide 17 in the form of a wedge profile, in axially displaceable but nonrotatable fashion. Snap ring 14 is preloaded in the direction toward drive gear 40 by a helical spring 18 that is enclosed in a cavity between a shoulder 21 of sleeve 16 and a shoulder 22 of snap ring 14. At the housing end, snap ring 14 has a plurality of snap lugs (merely indicated with the number 15) into which corresponding snap lugs on housing 11 engage.

Snap ring 14 can thus be pulled outward against the force of helical spring 18, rotated together with tool drive shaft 30, and then snap-locked in a different angular position.

All in all, adjusting device 20 thus allows tool drive shaft 30 to be axially adjusted and retained in various predefined axial positions.

Tool drive shaft 30 is mounted by way of a locating bearing 34 that is enclosed between washers 33 and 35 and immovably installed on adjusting sleeve 13 by way of a retaining ring 36. An undercut is provided on adjusting sleeve 13 so that a cavity 55 that is delimited on the tool side by a shoulder 31 and on the housing side by washer 33 is formed between tool drive shaft 30 and adjusting sleeve 13. Inside this cavity 55, a retaining ring 32 is retained on tool drive shaft 30. The axial adjustment range of tool drive shaft 30 in the direction toward drive gear 40 is thus limited by contact of retaining ring 32 against washer 33. In the opposite direction, the axial adjustment range of tool drive shaft 30 is limited by a retaining ring 39 that is immobilized on adjusting sleeve 13 and is stopped at the housing side against a shoulder 57.

In the position shown in FIG. 1, the tool drive shaft is located in the maximally outwardly adjusted position, which is limited by contact of adjusting ring 39 against shoulder 57 of housing 11. What therefore results is a minimal overlap of the flanks of first and second clutch elements 41, 46 on drive gear 40 and cam ring 45, and thus a minimal release torque for release clutch 50.

According to the present invention, there are provided in addition to clutch elements 41, 46 first entrainment elements 42 on drive gear 40 and second entrainment elements 47 on cam ring 45, coordinated with one another in shape and size.

These entrainment elements 42 and 47 are claws with straight, axially parallel flanks.

The shape and arrangement of the clutch elements and entrainment elements will now be explained in more detail with reference to FIGS. 2 and 3.

Figure 2:
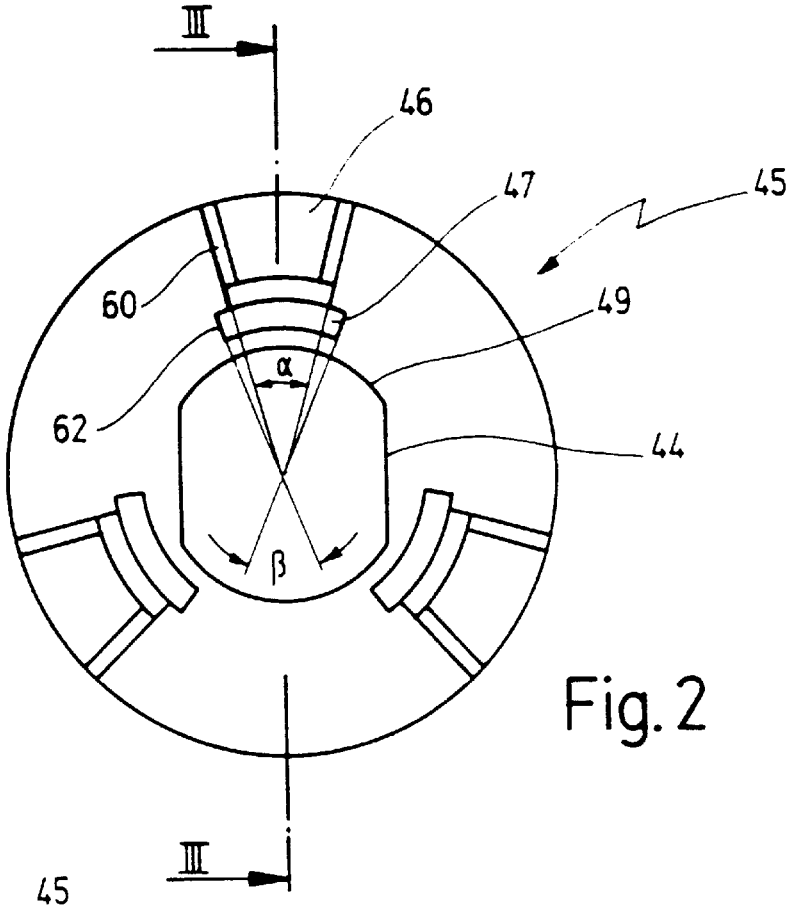
FIG. 2 shows a plan view of the cam ring as shown in FIG. 1, in an enlarged representation.
Figure 3:
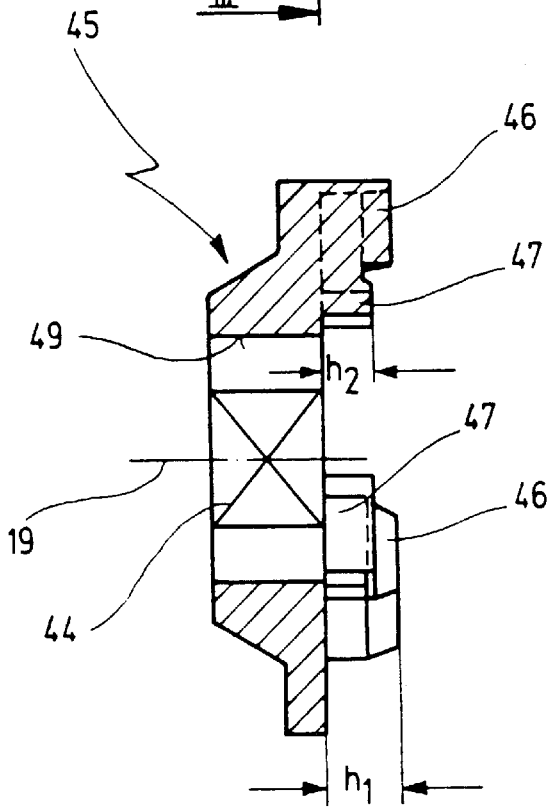
FIG. 3 shows a section through the cam ring as shown in FIG. 2, along line III—III.

In FIGS. 2 and 3, cam ring 45 is shown in enlarged fashion in plan view and in section along line III—III. Drive gear 40, on which the corresponding first clutch elements 41 and first entrainment elements 42 are provided, was not additionally shown, since its configuration is complementary to that of second clutch elements 46 and second entrainment elements 47 on cam ring 45.

It is evident from the plan view of FIG. 2 that three second clutch elements 46 and three second entrainment elements 47 are respectively arranged on the surface of cam ring 45, offset from one another in each case by angles of 120°. Second clutch elements 46 are arranged externally, while second entrainment elements 47 are arranged in the same respective angular position, but offset radially inward. Second clutch elements 46 are configured as cam elements having flat, oblique flanks 60. Second entrainment elements 47, on the other hand, are configured as claw elements with flat flanks 62 extending in the axial direction. Second clutch elements 46 extend over an angle at center a that is less than the angle at center β over which second entrainment elements 47 extend.

It is evident from FIG. 3 that clutch elements 46, viewed from the surface of cam ring 45, have a height $h_1$ that is greater than the correspondingly measured height $h_2$ of entrainment elements 47.

This configuration makes it possible to adjust tool drive shaft 30, by way of adjusting device 20, in a range such that only clutch elements 41 and 46 with the oblique flanks are effective when the screwdriver is put into operation and tool drive shaft 30 is pressed with muscle force, with its tool 24, against the action of spring element 43, so that clutch elements 41, 46 come into engagement.

Depending on the axial position of tool drive shaft 30 that is established, what therefore results is either a large overlap of the oblique flanks of clutch elements 41 and 46 and thus a large release torque, or—as in the position shown in FIG. 1—a small overlap between the oblique flanks of clutch elements 41 and 45, resulting in a small release torque.

If tool drive shaft 30 is then adjusted, by way of adjusting device 20, sufficiently far toward drive gear 40 that entrainment elements 42 and 47 on drive gear 40 and cam ring 45, respectively, come into positive engagement with one another, clutch elements 41 and 46 are thus nonfunctional, and rigid through drive is achieved. Because of the straight flanks, running in the axial direction, of entrainment elements 42 and 47, no axial forces occur in this context. Since entrainment elements 47 on cam ring 45 and also entrainment elements 42 of complementary configuration on drive gear 40 extend over a greater angle at center β than clutch elements and 46, clutch elements 41 and 46 are completely nonfunctional in this position.

Drive gear 40 is supported on the housing side via an axial bearing 52 and a bushing 56 arranged behind it, with an elastic element 54 in the form of an O-ring located therebetween.

Because of this slightly resilient mounting system of drive gear 40, it is possible to diminish or avoid a jamming tendency between clutch elements 41 and 46 that cannot be completely ruled out in unfavorable situations. Although theoretically no adjustment of adjusting device 20 should occur while working, even such adjustments during operation can be tolerated because of the resilient mounting system. Even if a switchover from torque-dependent release to rigid through drive had occurred, by way of a rotation of snap ring 14, while the machine was at a standstill, entrainment elements 42 and 47 still do not come into engagement until screwdriver 10 is subsequently switched on. Impacts created thereby are also intercepted by the resilient mounting system.

What is claimed is:

1. A power-driven screwdriver comprising:

a housing;

an axially displaceable tool drive shaft, at a first end thereof mounted within said housing rotatably about a rotation axis, and having a receptacle for a tool at a second end thereof;

a motor-driven drive gear, which is mounted rotatably on said tool drive shaft, and which is secured by said housing against axial displacement;

a cam ring that is axially fixed on said tool drive shaft and that is secured against axial displacements toward said receptacle;

a spring element for preloading said tool drive shaft outwardly toward said receptacle;

first clutch elements arranged on said drive gear;

second clutch elements arranged on said cam ring and coacting with said first clutch elements for forming a torque-dependent release clutch;

an adjusting means for axially adjusting said tool drive shaft; and first entrainment elements provided on said drive gear and coacting with second entrainment elements provided on said cam ring, for effecting positive power transfer;

wherein said adjusting means is adapted for axially adjusting said tool drive shaft between a first position and a second position, said first and second entrainment elements positively engage with one another, when being in said first position; and said first and second entrainment elements are out of engagement, and said clutch elements are in engagement with one another, when being in said second position.

2. The screwdriver of claim 1, wherein said clutch elements are out of engagement, when being in said first position.

3. The screwdriver as defined in claim 2, wherein said clutch elements are configured as cam elements having oblique flanks.

4. The screwdriver of claim 3, wherein said entrainment elements are configured as claw elements having straight flanks extending in parallel to said rotation axis.

5. The screwdriver of claim 2, wherein said first clutch elements are arranged on said drive gear at uniform angular distances from one another;

said second clutch elements are matched with said first clutch elements;

said first entrainment elements are arranged on said drive gear at uniform angular distances from one another;

said second entrainment elements are matched with said first entrainment elements;

said first and second entrainment elements each extend over an angle at center that is greater than an angle at center over which said first and second clutch elements extend.

6. The screwdriver of claim 5, wherein said first and second clutch elements extend axially over a first height, said first and second entrainment elements extend axially over a second height, said first height being greater than said second height.

7. The screwdriver of claim 5, wherein said first and second clutch elements are arranged on a circle that is offset concentrically outward with respect to said first and second entrainment elements.

8. The screwdriver of claim 7, wherein each of said first and second clutch elements is associated with a respective one of said first and second entrainment elements in a radially outwardly offset position.

9. The screwdriver of claim 1, wherein said adjusting means comprises an adjusting sleeve having threads engaging matching threads provided on said housing, thereby allowing to axially adjust said adjusting sleeve by rotating the latter with respect to said housing.

10. The srewdriver of claim 9, wherein said adjusting sleeve further comprises a snap ring arranged rotatably and axially shiftable against a resilient means between a first position with respect to said housing and a second position with respect to said housing.

11. The screwdriver of claim 10, wherein said snap-ring comprises a plurality of snap-lugs arranged at one end thereof facing said housing and coacting with respective snap-lugs provided on said housing, said snap-lugs of said snap-ring and said housing engaging each other to lock said snap-ring against rotation in a selected angle of rotation, when being in said first axial position, and allowing to rotate said snap-ring with respect to said housing when being in said second axial position.

12. The screwdriver of claim 1, further comprising an axial bearing and a resilient element, said resilient element resting on said housing and preloading said axial bearing for axially supporting said drive gear.

* * * * *